United States Patent [19]

Hawkes et al.

[11] 4,153,963

[45] May 15, 1979

[54] COVER BREAKER MECHANISM

[75] Inventors: Richard B. Hawkes, Easton; Donald P. Johnson, Bethlehem; John E. Morgenstern, Tatamy, all of Pa.

[73] Assignee: Harris Corporation, Cleveland, Ohio

[21] Appl. No.: 761,618

[22] Filed: Jan. 24, 1977

[51] Int. Cl.[2] ..... B42C 11/00

[52] U.S. Cl. ..... 11/3; 11/4

[58] Field of Search ..... 11/1 R, 1 AD, 3, 4

[56] References Cited

U.S. PATENT DOCUMENTS

| | | | |
|---|---|---|---|
| 1,248,252 | 11/1917 | Bredenberg | 11/4 |
| 1,274,154 | 7/1918 | Etheridge | 11/4 |
| 2,083,720 | 6/1937 | Lariviere | 11/3 |

FOREIGN PATENT DOCUMENTS

| | | | |
|---|---|---|---|
| 2430114 | 1/1975 | Fed. Rep. of Germany | 11/3 |
| 751604 | 7/1956 | United Kingdom | 11/4 |
| 1052938 | 12/1966 | United Kingdom | 11/3 |

*Primary Examiner*—Stephen C. Pellegrino

[57] ABSTRACT

A cover breaker mechanism which functions to shape a cover to the back of a book which is moving in one direction. The cover breaker mechanism includes a bottom plate for engaging the bottom portion of the cover which forms the back of the book and a pair of side bars for engaging portions of the cover which lie adjacent the back of the book on opposite sides of the book. The bottom plate and side bars are carried on a support which moves from a start position in a first path which causes the bottom plate and side bars to act on the cover, and in a second path spaced from the first path for returning the bottom plate and side bars to the start position. A means is provided for moving the support which includes a pair of members which are supported on respective eccentrics. A crank mechanism rotatably moves the members relative to the eccentrics and a cam and linkage mechanism is provided for rotating the eccentrics during at least a part of the time that the crank is moving the members so as to effect movement of the support along the first and second paths.

9 Claims, 6 Drawing Figures

COVER BREAKER MECHANISM

BACKGROUND OF THE PRESENT INVENTION

The present invention relates to a cover breaker mechanism for shaping a cover to the back of a moving book. Cover breaker mechanisms traditionally form a part of known binder mechanisms. Such binder mechanisms generally include a clamp for engaging opposite sides of a book and for conveying the book past a plurality of operating stations. At these operating stations the back of the book is treated and glue applied thereto and a cover is moved into engagement with the back of the book and applied to the back of the book. The cover breaker mechanism is provided in the bindery for purposes of shaping the cover to the back of the moving book.

Traditionally, cover breaker mechanisms have been rather complicated, involving numerous crank mechanisms and linkage mechanisms to provide for the proper movement of various elements of the cover breaker mechanism to effect the required operations on the book. Cover breaker mechanisms have generally included a bottom plate which engages a portion of the cover which forms the back of the book and a pair of side bars which engage portions of the cover which lie adjacent the back of the book on opposite sides of the book. The bottom plate and side bars are moved along a path adjacent the path of movement of the books and in a direction generally parallel thereto. As the cover breaker mechanism moves along the path of movement of the clamps, the bottom plate and side bars are actuated in order to effect the shaping of the cover to the back of the book.

SUMMARY OF THE PRESENT INVENTION

The present invention is directed to a cover breaker mechanism which functions to shape a cover to the back of a book, and which cover breaker mechanism includes a bottom plate and a pair of side bars which have the general functions as do the bottom plate and side bars in the prior art. The present invention, however, is believed to provide a simplified cover breaker mechanism, and particularly a simplified mechanism for effecting movement of the side bars and bottom plate of the cover breaker mechanism relative to the path of movement of the books.

In accordance with the present invention, the bottom plate and side bars of the cover breaker mechanism are carried on a support and the support in turn is carried on at least one member which is rotatably supported on an eccentric. A first crank mechanism is associated with the member and operates to move the member rotatably relative to the eccentric and effects movement of the support in a direction generally parallel to the direction of movement of the book being carried in the bindery clamps. A mechanism is provided for rotating the eccentric during at least a part of the time that the crank is moving the member so as to modify movement of the member by the crank in accordance with the action of the eccentric.

In accordance with the present invention, the cover breaker mechanism can be moved in a first path from a start position to relatively closely adjacent the path of movement of the books and along the path of movement of the books so that the bottom plate and side bars can act on the cover.

During movement along the first path, the bottom plate and side bars move at a velocity which matches the velocity of the books as they are carried by the binder book clamps. Also, the bottom plate and side bars have a period of movement at a constant level. The mechanism is returned to the start position along a second path spaced from the first path.

Further, in accordance with the present invention, the side bars of the cover breaker mechanism are moved toward each other and into engagement with the side portions of the cover which lie adjacent the back of the book by a simplified linkage arrangement which operates to effect movement of the side bars in response to movement of the cover breaker assembly in a direction generally parallel to the path of movement of the books. This linkage arrangement involves at least one link which is attached to each of the side bars and which is universally connected at one end to the frame of the machine and at the other end to the moving side bar. As a result, due to the pivoting action of the link the side bars move inwardly toward each other and toward the back of the book during movement of the cover breaker assembly, and due to the universal connection the links enable some verticle movement of the side bar to occur.

BRIEF DESCRIPTION OF THE DRAWINGS

Further and more specific features of the present invention will be apparent to those skilled in the art to which the present invention relates from a detailed description thereof made with reference to the accompanying drawings in which.

DESCRIPTION OF THE PREFERRED EMBODIMENT

Figure 1:
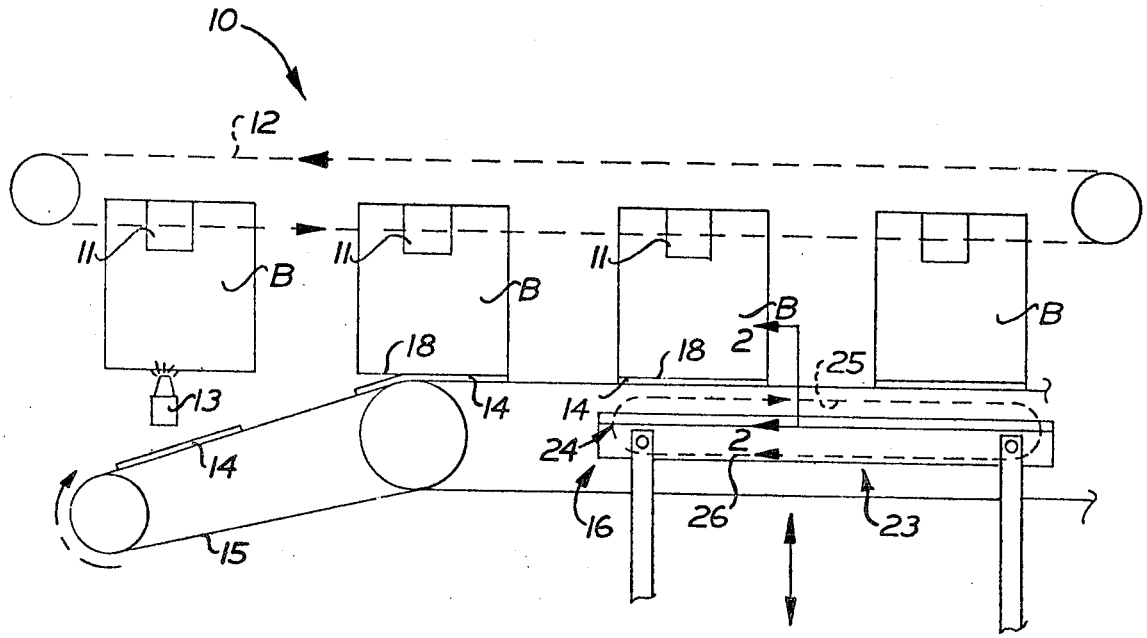
FIG. 1 is a schematic representation of a binder with a cover breaker mechanism in accordance with the present invention.

As noted hereinabove, the present invention relates to an improved cover breaker mechanism for use in a bindery system. The bindery system in which the cover breaker mechanism of the present invention may be used may vary. FIG. 1 schematically illustrates a bindery mechanism 10 which is merely illustrative of the type of bindery in which the breaker mechanism of the present invention may be used.

The bindery mechanism 10 includes bindery clamps (schematically shown at 11), which are carried by a conveyor 12. The clamps are well known, and engage opposite sides of books B and move the books past a plurality of operating stations. At one operating station (schematically shown at 13) glue is applied to the back of the book in a known manner. A cover 14 being moved by conveyor 15 in timed relation to the movement of the book is moved into position beneath the book to which glue has been applied. The cover 14 is then moved into engagement with the back of the book and a cover breaker mechanism 16 then functions to shape the cover to the back 18 of the book.

Figure 2:
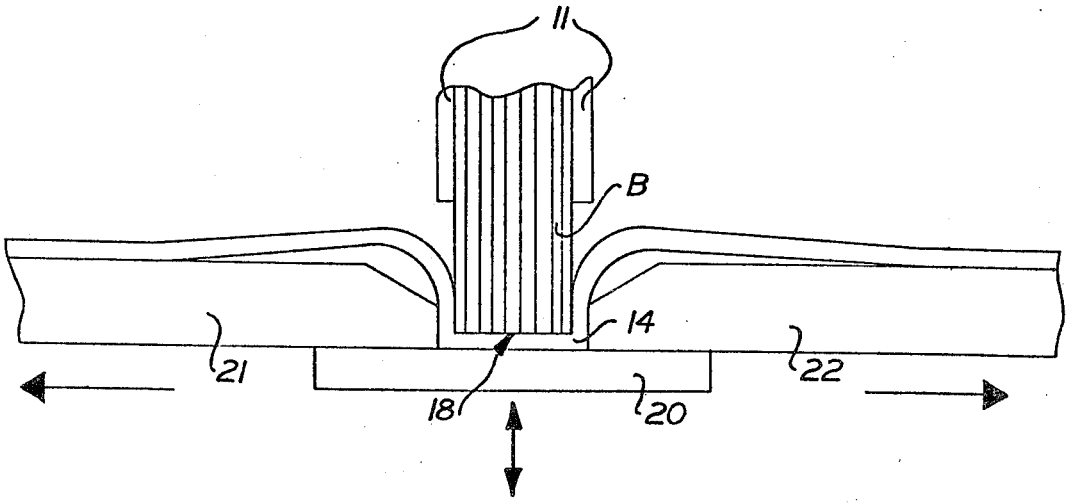
FIG. 2 is a further schematic front view of a cover breaker mechanism such as shown in FIG. 1, taken from the direction 2—2, and showing the function of the cover breaker mechanism somewhat schematically.

The cover breaker mechanism includes a frame 19 which is disposed in a preset positional relationship to the path of movement of the books, and a series of elements which are moveable with respect to the frame to effect the shaping of the cover to the book. As shown in FIG. 2, these elements include a bottom plate 20 which engages the portion of the cover which covers the back 18 of the book and side bars 21 and 22 which engage portions of sides of the cover adjacent the back of the book and on opposite sides of the book.

The bottom plate 20 and the side bars 21 and 22 are supported on a support member 23 which is moved in order to effect engagement of the bottom plate and the side bars with the cover. Specifically, the support 23 is moved along a first path in the general direction of movement of the books by conveyor 12. The first path is schematically shown at 25 in FIG. 1. The cover breaker assembly then returns to a start position 24 along a second path which is generally designated 26 and which path is spaced downwardly away from the first path 25. In effect, the cover breaker mechanism moves in a closed path of movement, moving along first path 25 in order to effect movement of the bottom plate and side bars into a position where the back of the book is shaped thereby and moving along second path 26 for returning the bottom plate and the side bars to the start position. As the cover breaker mechanism moves along the first path 25, the support member 23 moves upwardly to bring the bottom plate 20 toward the bottom of the book, and at the same time the side bars 21 and 22 move toward the opposite sides of the back of the book. As the cover breaker mechanism moves along second path 26 the support member 23 initially moves downwardly and, toward the end of path 22 the support member 23 moves upwardly to the start position 24.

The cover breaker mechanism moves along the path 25 at a velocity which is matched to the velocity of the books B carried by the binder book clamps 11. Further, as the cover breaker mechanism moves along path 25, it moves at a constant elevation which could be termed as occurring during a "dwell period", i.e., the cover breaker mechanism "dwells" at a constant elevation.

The cover breaker mechanism is moved in its closed path of movement by a mechanism which is generally designated 30. The mechanism 30 includes a pair of arms 31 and 32 which extend generally vertically. The upper ends of each arm is supported in bearings 33 which encircle a respective shaft 34. Each shaft 34 is journaled in blocks 35. The lower end of the arm 32 is rotatably supported on an eccentric 36 and the lower end of the arm 31 is rotatably supported by an eccentric 37. The eccentrics 36, 37 are each drivingly connected with a respective shaft 38, 39.

Figure 5:
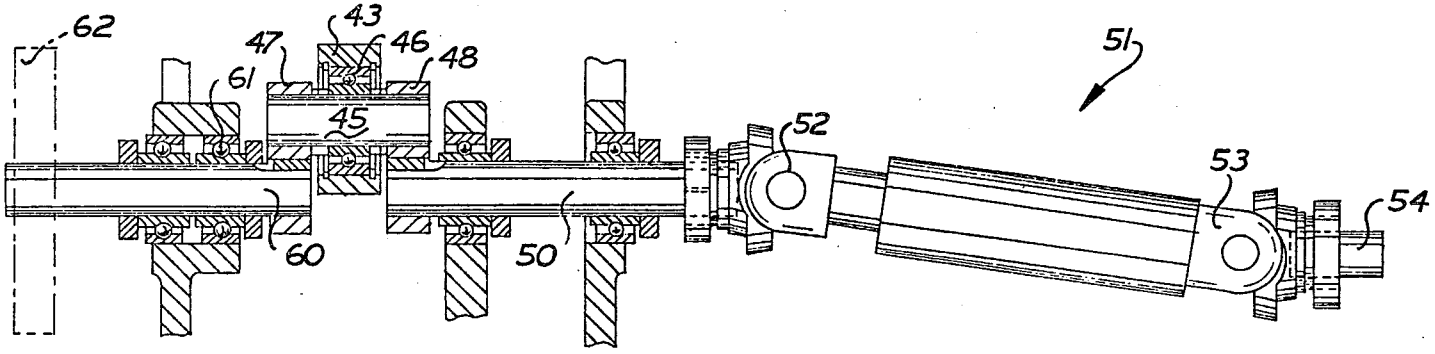
FIG. 5 is a view of the cover breaker mechanism embodying the present invention taken approximately along the line 5—5 of FIG. 3.

The arms 31 and 32 are moved rotatably around the outer periphery of the eccentric 36 and 37 by a crank mechanism, generally designated 40. The crank mechanism 40 includes a crank arm 41 which is pivotally attached at 42 to the arm 31. The other end of the crank arm 41 which is designated 43 is rotatably attached to a shaft 45 (FIG. 5). The shaft 45 has a bearing 46 encircling it and the end 43 of the arm 41 encircles the bearing 46. The shaft 45 has its opposite ends carried in collars 47 and 48. The collar 48 is drivingly connected to a drive shaft 50 which is suitably driven from the main drive shaft of the binder. Specifically, the drive shaft 50 is driven by a universal driving link 51. The driving link 51 is connected to the drive shaft 50 by a universal-type connection 52 which will not be described in detail. Likewise, the opposite end of the drive link 51 is connected by a universal driving connection 53 to a drive shaft 54 which is driven in timed relation to the binder clamps.

From the above, it will be apparent that upon rotation of the shaft 50, the collars 47 and 48 are rotated therewith. The end 43 of the crank arm will be moved around the axis of the shaft 50 and will rotate relative to the axis of the shaft 45. Because of the connection between the crank arm 41 and the arms 31, 32 the arms 31, 32 will simultaneously oscillate.

Figure 3:
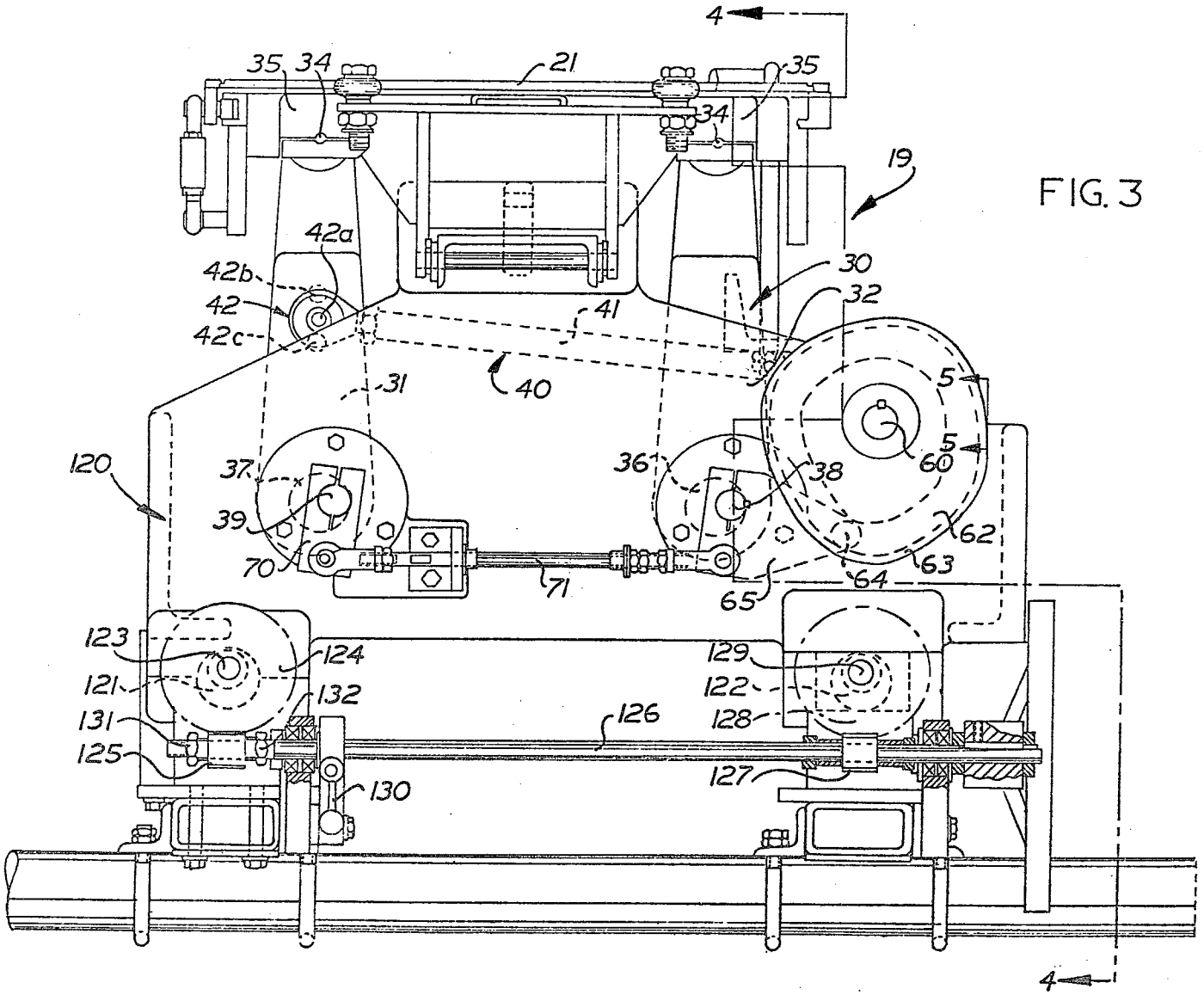
FIG. 3 is a side elevational view of the cover breaker mechanism embodying the present invention.
Figure 4:
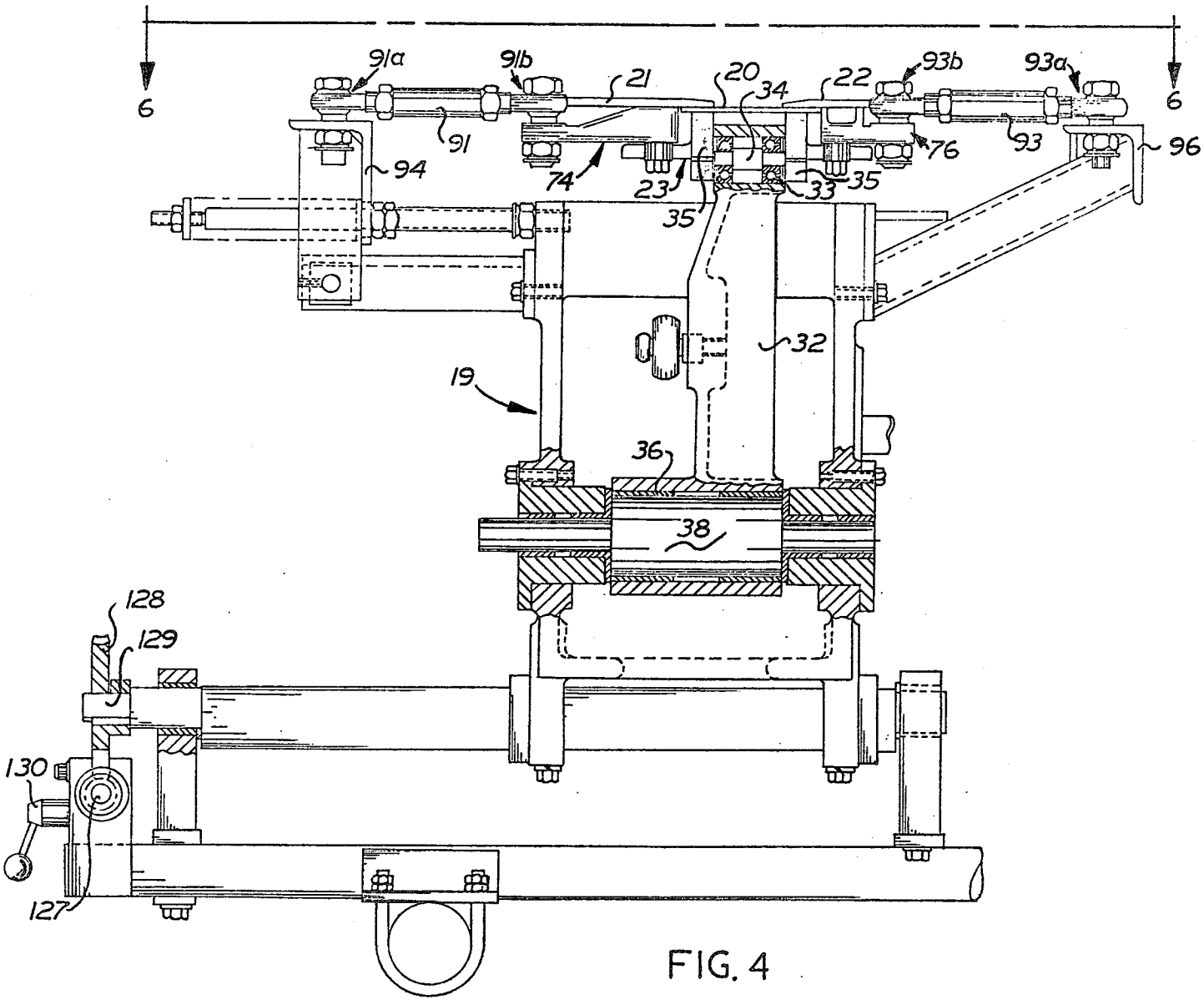
FIG. 4 is a view of the cover breaker mechanism of FIG. 3 taken approximately along the 4—4 of FIG. 3, with certain portions omitted.

The collar 47 is drivingly connected to a shaft 60 which is coaxial with the shaft 50. The shaft 60 is suitably supported in bearings 61 in the frame of the unit. The outer end of the shaft 60 carries a cam member 62, best shown in FIG. 3. The cam member 62 is preferably a box cam having a groove 63 which extends interiorly around the cam 62. A follower roller 64 is disposed in the groove 63 and is moveable in accordance with the profile of the groove.

The roller 64 is suitably carried on a link 65. Link 65 is drivingly connected to the shaft 38 connected with the eccentric 36. Therefore, upon rotation of the cam 62, the link 65 and follower 64 will effect a rotation of the eccentric 36 in accordance with the profile of the groove 63 on the cam.

The link 65 is also connected to a link 70 by a suitable connecting rod 71. The link 70 is drivingly connected to the shaft 39 of the eccentric 37. The eccentrics 36, 37 extend or lie in similar positions and the links 70 and 65 also lie in similar positions. Upon rotation of the cam 62, the links 65, 71 and 70 will effect simultaneous rotation of the eccentrics 36 and 37 by equal amounts. The rotation of the eccentrics 36, 37 is effected in timed relation to the oscillation of the arms 31, 32. The movement is such that as the arms 31, 32 are oscillated in one direction they are raised vertically to move bottom plate 20 upward and into engagement with cover 14 to urge the cover against the back 18 of the moving book. As the arms 31, 32 are oscillated in a second direction they are lowered vertically so that the bottom plate 20 and the side plates 21, 22 are maintained out of engagement with the cover 14. The arms 31 and 32, and the bottom plate 20 and side plates 21 and 22, (which are also carried by the arms 31, 32 as set forth hereinafter), move as a result of the combined action movement of crank mechanism 40 and the eccentrics 36, 37. Specifically, the single crank mechanism 40 and the eccentrics 36 and 37 effect movement of the cover breaker assembly in the manner described above along the closed path of movement of the cover breaker mechanism.

Further, the cover breaker mechanism of the present invention is readily adjustable for use with binders having different length clamp increments. As is known, if the distance between binder clamps 11 changes, the distance of movement of the cover breaker mechanism along the clamp path should change. This adjustment can be readily accomplished by changing the location of the pivot connection 42. For this purpose, link 31 is provided with a plurality of vertical spaced openings (three illustrated), each of which may selectively receive the pivot pin **42*a*. Opening 42*b* and 42*c* are illustrated as located above and below respectively, the opening receiving the pivot pin 42***a* as illustrated in the drawings.

According to a further feature of the invention, as the bottom plate 20 is moved up into engagement with the underside of a book in order to shape the bottom of the cover to the book the side plates 21, 22 are also moved inwardly toward each other. The inward movement of the side plates 21, 22 is effected by links which are attached to the side plates. The side plate 21 is adjustably mounted on a support structure 74, and the side plate 22 is fixedly mounted on a support structure 76. The support structure 74 has spaced links 90 and 91 attached thereto, and the support structure 76 has spaced links 92 and 93 attached thereto. Universal couplings serve to attach a first end of each respective link 90, 91, 92 and 93 to portions 94, 96 of the frame of the machine. These first ends of the links are designated 90*a*, 91*a*, 92*a* and 93*a*. The other end of each of the links is also connected by a universal coupling to the respective side bar support structure. These ends of the links are designated 90*b*, 91*b*, 92*b* and 93*b*.

Figure 6:
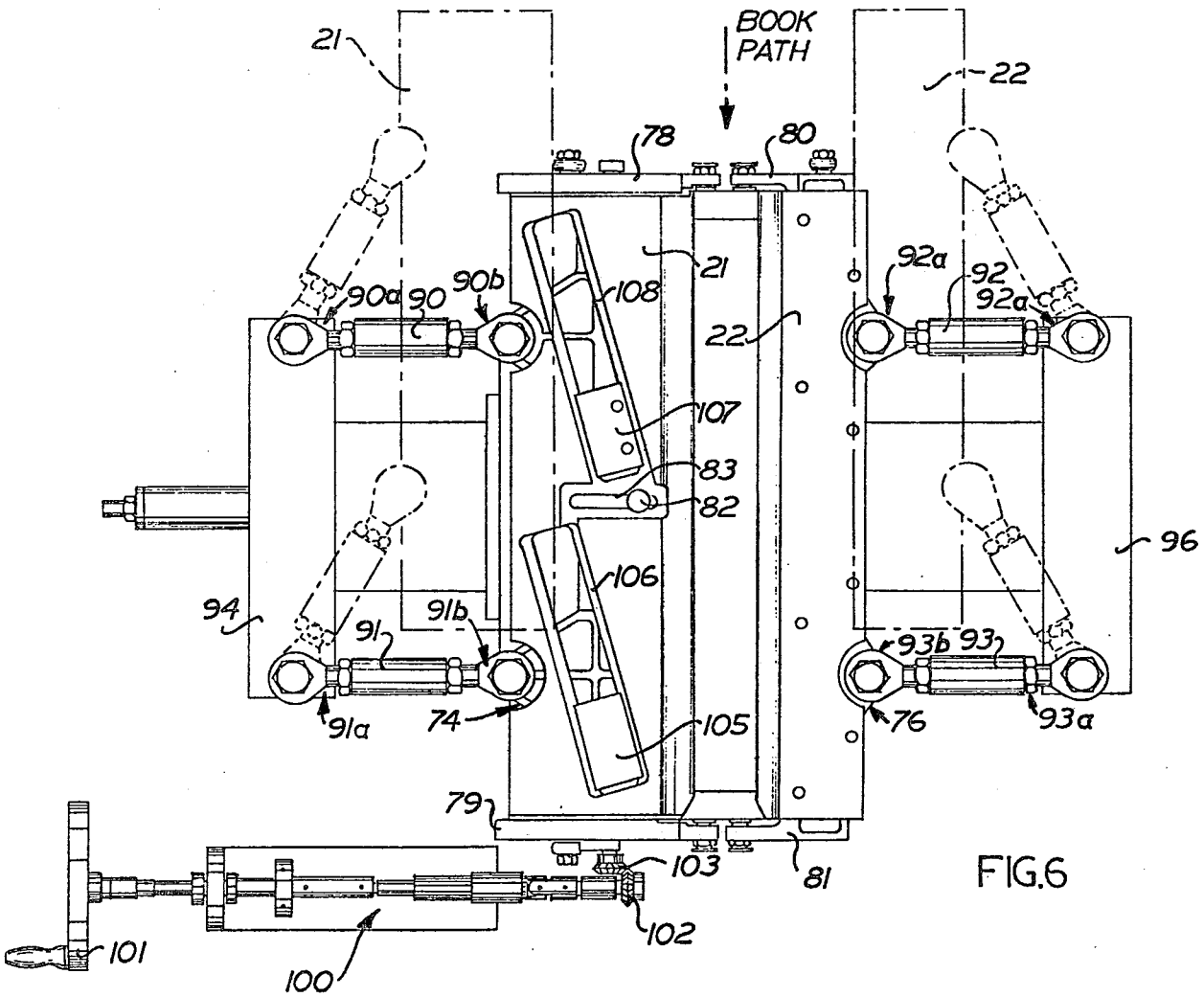
FIG. 6 is a somewhat schematic view of the cover breaker mechanism, taken approximately along the line 6—6 of FIG. 4.

The side bar 21 and its respective support structure 74 are supported between guide members 78, 79 which extend transverse to the path of movement of the books. Side plate 22 and its respective support structure 76 are also supported between guide members 80, 81 which are also disposed transversely to the path of movement of the books. The blocks 35 which support the bottom plate 20 are also fixedly connected with the guide members 78, 79, 80, 81 so that oscillation of the crank serves to oscillate the guide members. As the guide members oscillate the universal mounting of the side bars 21, 22 enables pivoting action to occur between the links and the frame, and between the links and their respective side bars. This causes the side bars to move toward and away from each other and therefore toward and away from the books being moved by the clamps 11. In addition, as a result of the universal couplings described above, vertical movement of each of the side bars can occur without being inhibited by a rigid connection of the links thereto. This allows movement of the side bars to accommodate the vertical component of the movement of the bottom plate support. As shown in FIG. 6, the side bars 20 and 21 are located in their inwardmost position. However, in the phantom position illustrated schematically in FIG. 6, the side bars 20, 21 are located in their respective start positions which are spaced from the moving books and covers.

The side bar 21 can be adjusted in accordance with the present invention by an adjustment mechanism, generally designated 100 to adjust for handling different thickness books. The adjustment mechanism includes a handwheel 101. The handwheel 101, when it is rotated, rotates a bevel gear 102 through a suitable shaft arrangement. The bevel gear 102 meshes with a bevel gear 103. The bevel gear 103 is connected to a shaft which extends parallel to the direction of book movement (see FIG. 6). The shaft is suitably threadedly connected to a block 105 supported in a slot 106 in the side bar 21. The shaft is also threadedly connected to a block 107 located in a slot 108 in the side bar 21, spaced from the slot 107. The slots 106 and 108 extend at an angle to the path of movement of the books. Rotation of the crank 101 serves to rotate the threaded shaft relative to the respective blocks 105, 107 and the blocks 105, 107 slide in their slots. This movement of the blocks 105 and 107 in the slots 106, 108 causes a camming of the side bar 21 relative to the support assembly 74 to vary the position of the side bar 21 relative to its support structure 74. A guide pin 82 which is connected with the supports structure 74 and which extends through a slot 83 in the side bar 21 also helps to guide proper adjusting movement of the side bar 21 toward and away from the path of the books. Accordingly, by movement of handwheel 101, the start position of the side bar 21 can be changed and thus the side bar 21 will move to a different final position. This enables different thickness books to be handled.

The cover breaker assembly of the present invention also embodies an adjustment mechanism for vertically adjusting the cover breaker assembly relative to the path of movement for the books. In this connection, a portion of the frame of the cover breaker assembly, which is generally designated 120, is supported in spaced locations on eccentrics 121 and 122. The eccentric 121 is mounted on a shaft 123 and is drivingly connected with a worm wheel 124 which, in turn, is drivingly connected to a worm 125 carried on a shaft 126. A similar worm 127 is carried on the shaft 126 and meshes with a worm wheel 128 which is drivingly connected with the eccentric 122 through a shaft 129. It should be clear that upon rotation of the shaft 126, the worms 125, 127 will be rotated and in turn effect rotation of the eccentrics 121, 122 for purposes of raising or lowering the cover breaker assembly to preset the position of the cover breaker assembly relative to the path of movement of the books.

In order to rotate the shaft 126, a handle 130 is attached thereto and may be moved to a variety of different positions. Further, for purposes of independent adjustment of one end of the cover breaker assembly relative to the other end for purposes of leveling the cover breaker assembly, the shaft 126 has a nut 131 thereon which is positioned at one side of the worm 125. A similar nut 132 is positioned at the other side of the worm 125. Interposed between each of the nuts and the worm is a suitable bearing. By rotation of the nuts, the position of the worm 125 can be adjusted along the axis of the shaft 126 and by movement of the nuts in this manner, rotation of the eccentric 121 can occur independently of rotation of the eccentric 122, and thus a leveling movement of the cover breaker mechanism can be effected. In the absence of rotation of the shaft 126 the cover breaker assembly maintains a fixed preset positional relationship to the path of movement of the books.

In view of the above, it should be clear that applicant has provided a substantially improved cover breaker mechanism as compared to the prior art.

Having described my invention, I claim:

1. A cover breaker mechanism for shaping a cover to the back of a book which is moving in one direction past the cover breaker mechanism, said cover breaker mechanism including a bottom plate for engaging the portion of the cover which forms the back of the book, a pair of side bars for engaging portions of the cover which lie adjacent the back of the book upon opposite sides of the book, a support for said bottom plate and said side bars, means for moving said support, bottom plate and side bars from a start position along a first path in said one direction so that said bottom plate and side bars act on the book and in a second path spaced from the first path for return to the start position, said means for moving said support comprising two members rotatably connected to said support located at spaced locations, each of said members being rotatably supported on respective eccentrics, a crank mechanism for rotatably moving said members relative to a shaft, and means for rotating said eccentrics relative to said members simultaneously and in an equal and like manner at least during a part of the time that the crank is moving to effect the vertical movement of the bottom plate and side bars of the cover breaker mechanism simultaneously with movement of the bottom plate and side bars of the cover breaker mechanism in the direction of the book by actuation of the crank mechanism.

2. A cover breaker mechanism as defined in claim 1 wherein said crank mechanism includes a rod having one end connected to said members and another end connected to a rotating part offset from the center of rotation of the part, and means enabling said one end of said rod to be connected to said members at different locations to adjust for different spacing between books moving past the cover breaker mechanism.

3. A cover breaker mechanism as defined in claim 1 further including means for moving said side bars toward each other upon movement of said support along said first path.

4. A cover breaker mechanism as defined in claim 3 including a frame supportable in a preset positional relationship to the book which is moving past the cover breaker mechanism, wherein said means for effecting movement of each of said side bars comprises at least one link attached to said frame and to the respective side bar by universal joint means which enable universal pivoting action of the link relative to the frame to move the side bars toward and away from each other and to enable movement of the side bars vertically relative to the frame of the machine.

5. A cover breaker mechanism as defined in claim 1 wherein said means for rotating said eccentrics comprises cam members and a linkage mechanism actuated by said cam members, said linkage mechanism having a first link drivingly connected to a first of said eccentrics and a second link drivingly connected to a second of said eccentrics and a bar interconnecting said links to effect simultaneous and equal rotation of said eccentrics upon actuation of said links by said cam members.

6. A cover breaker mechanism as defined in claim 1 further including means for vertically adjusting the position of the cover breaker mechanism comprising further eccentric means supporting the frame of the cover breaker mechanism and which are rotatable to effect vertical adjustment of the frame to the preset positional relationship to the moving books.

7. A cover breaker mechanism as defined in claim 6 wherein said further eccentric means comprises a pair of spaced eccentrics supporting the frame of the cover breaker mechanism in spaced locations and means for rotating said eccentrics, said means for rotating said eccentrics including means for rotating one of said eccentrics independently of the other in order to effect rotation of one eccentric for leveling the cover breaker mechanism.

8. A cover breaker mechanism for shaping a cover to the back of a book which is moving in one direction past the cover breaker mechanism, said cover breaker mechanism including a frame, a bottom plate for engaging the portion of the cover which forms the back of the book, a pair of side bars for engaging portions of the cover which lie adjacent the back of the book on opposite sides of the book, a support for said bottom plate and said side bars, means for moving said support from a start position along a first path in said one direction so that said bottom plate and side bars act on the book and in a second path spaced from the first path for returning said bottom plate and said side bars to the start position, means for effecting movement of said side bars into engagement with the portions of the cover which lie adjacent the back of the book on opposite sides of the book in response to movement of the support along said first path of movement, said last mentioned means comprising at least one link attached to the side bar and to a portion of the frame adjacent thereto, and means connecting the opposite ends of the link to the frame and side bar, respectively, for universal movement for enabling vertical movement of the side bar to occur as well as movement of the side bar in a direction having a first component generally transverse to the direction of movement of the books and a second component generally parallel to the direction of movement of the books.

9. A cover breaker mechanism as defined in claim 8 further including means for adjusting the position of the side bar relative to the frame in said start position so that the range of movement of the side bar relative to the path of movement of the books may be varied so that the side bar can act on books of different thicknesses.

* * * * *